US010378496B2

(12) United States Patent
Miyamoto et al.

(10) Patent No.: US 10,378,496 B2
(45) Date of Patent: Aug. 13, 2019

(54) FUEL INJECTION VALVE

(71) Applicant: HITACHI AUTOMOTIVE SYSTEMS, LTD., Hitachinaka-shi, Ibaraki (JP)

(72) Inventors: Akiyasu Miyamoto, Tokyo (JP); Motoyuki Abe, Tokyo (JP); Yoshihito Yasukawa, Tokyo (JP); Takao Miyake, Hitachinaka (JP); Akira Iizuka, Hitachinaka (JP); Kiyotaka Ogura, Hitachinaka (JP)

(73) Assignee: HITACHI AUTOMOTIVE SYSTEMS, LTD., Hitachinaka-Shi, Ibaraki (JP)

( * ) Notice: Subject to any disclaimer, the term of this patent is extended or adjusted under 35 U.S.C. 154(b) by 0 days.

(21) Appl. No.: 15/545,930

(22) PCT Filed: Jan. 8, 2016

(86) PCT No.: PCT/JP2016/050411
§ 371 (c)(1),
(2) Date: Jul. 24, 2017

(87) PCT Pub. No.: WO2016/121444
PCT Pub. Date: Aug. 4, 2016

(65) Prior Publication Data

US 2017/0370337 A1 Dec. 28, 2017

(30) Foreign Application Priority Data

Jan. 26, 2015 (JP) ..... 2015-011929

(51) Int. Cl.
*F02M 51/00* (2006.01)
*F02M 51/06* (2006.01)
(Continued)

(52) U.S. Cl.
CPC ..... *F02M 51/0625* (2013.01); *F02M 51/06* (2013.01); *F02M 51/066* (2013.01);
(Continued)

(58) Field of Classification Search
CPC ..... F02M 51/0625; F02M 61/166; F02M 2200/02; F02M 2200/03; F02M 2200/36;
(Continued)

(56) References Cited

U.S. PATENT DOCUMENTS 2,607,368 A * 8/1952 Mayer ..... F16K 31/0651 251/129.21
4,030,668 A * 6/1977 Kiwior ..... F02M 51/005 239/568
(Continued)

FOREIGN PATENT DOCUMENTS

DE 10 2011 078 732 A1 1/2013
EP 2 574 768 A1 4/2013
(Continued)

OTHER PUBLICATIONS

Extended European Search Report dated Sep. 24, 2018 in Application No. 16743048.7.

*Primary Examiner* — Viet Le
(74) *Attorney, Agent, or Firm* — Foley & Lardner LLP

(57) ABSTRACT

An object of the present invention is to provide a fuel injection valve configured to suppress bouncing of a valve element that is caused as a result of the valve element being rendered elastic when the valve element collides with a valve seat.

The fuel injection valve of the present invention includes the valve element configured to come into contact with the valve seat for closing an injection hole and to separate from the valve seat for unclosing the injection hole, an elastic member urging the valve element toward the valve seat, a
(Continued)

movable iron core disposed to be in and out of contact with the valve element, a fixed iron core disposed to be opposed to the movable iron core, and a coil configured to generate electromagnetic force for moving the movable iron core. At least one lower rigidity part having reduced rigidity per axial unit length is provided between a surface where urging force of the elastic member is transmitted to the valve element and a seat part whereat the valve element comes into contact with and separates from the valve seat.

5 Claims, 6 Drawing Sheets

(51) Int. Cl.
*F02M 61/10* (2006.01)
*F02M 61/16* (2006.01)
*F02M 61/18* (2006.01)
*F02M 61/20* (2006.01)

(52) U.S. Cl.
CPC ..... *F02M 51/0685* (2013.01); *F02M 61/10* (2013.01); *F02M 61/16* (2013.01); *F02M 61/166* (2013.01); *F02M 61/18* (2013.01); *F02M 61/205* (2013.01); *F02M 2200/00* (2013.01); *F02M 2200/26* (2013.01); *F02M 2200/306* (2013.01); *F02M 2200/9015* (2013.01)

(58) Field of Classification Search
CPC .. F02M 2200/30; F02M 2200/31; F16K 1/38; F16K 31/0651; F16K 31/0655
USPC ..... 239/88, 89, 91, 533.1, 533.2, 533.3, 239/533.11, 533.13, 585.1–585.5; 251/129.15, 129.21, 127, 903
See application file for complete search history.

(56) References Cited

U.S. PATENT DOCUMENTS 4,164,920 A * 8/1979 Brinkman ..... F02D 1/025 123/382
4,466,571 A * 8/1984 Muhlbauer ..... F02M 45/10 239/101
4,529,165 A * 7/1985 Lehrach ..... F02M 59/366 137/469
4,967,966 A * 11/1990 Babitzka ..... F02M 51/0614 239/585.4
5,127,585 A 7/1992 Mesenich
5,236,173 A * 8/1993 Wakeman ..... F02M 51/0653 239/585.3
5,392,745 A * 2/1995 Beck ..... F02M 47/02 123/295
5,544,816 A * 8/1996 Nally ..... F02M 51/005 239/585.5
5,636,827 A * 6/1997 Kilgore ..... F02M 51/066 239/585.5
5,662,275 A * 9/1997 Lambert ..... F02M 61/08 239/533.6
5,921,475 A * 7/1999 DeVriese ..... F02M 51/0671 239/585.4
5,975,436 A * 11/1999 Reiter ..... F02M 61/168 239/533.9
6,015,103 A * 1/2000 Kotkowicz ..... F02M 51/0671 239/533.11
6,027,050 A * 2/2000 Rembold ..... F02M 51/0671 239/463
6,279,844 B1 * 8/2001 Shen ..... F02M 51/0671 239/585.1
6,390,067 B1 * 5/2002 Haltiner, Jr. ..... F02M 51/0667 123/470
6,543,700 B2 * 4/2003 Jameson ..... F02M 57/023 239/102.1
6,663,027 B2 * 12/2003 Jameson ..... F02M 57/023 239/102.1
6,764,058 B1 * 7/2004 Brenk ..... F02M 45/00 251/48
6,808,133 B1 10/2004 Stier
6,871,800 B2 * 3/2005 Tinwell ..... F02M 51/0685 239/533.2
6,874,703 B2 * 4/2005 Gottemoller ..... F02M 61/16 239/533.2
8,746,514 B2 * 6/2014 Tudor ..... B05C 5/0225 222/504
9,506,429 B2 * 11/2016 Peters ..... F02M 27/08
9,530,551 B2 * 12/2016 Dames ..... H01F 7/122
2003/0146308 A1 * 8/2003 Yamashita ..... F02M 51/0671 239/585.1
2004/0149949 A1 * 8/2004 Eriksson ..... A61M 16/20 251/186
2006/0016916 A1 * 1/2006 Petrone ..... F02M 51/0671 239/533.2
2006/0027685 A1 * 2/2006 Reiter ..... F02M 51/0675 239/585.1
2006/0151638 A1 * 7/2006 Boecking ..... F02M 45/086 239/533.2
2009/0108107 A1 * 4/2009 Kitagawa ..... F02M 61/168 239/585.4
2009/0200405 A1 * 8/2009 Yoshimaru ..... F02M 51/0685 239/585.1
2011/0133002 A1 * 6/2011 Kuegler ..... F02M 61/10 239/584
2012/0318893 A1 * 12/2012 Crossley ..... F02M 51/0675 239/584
2013/0153801 A1 * 6/2013 Sato ..... F16K 31/0655 251/129.21
2017/0261113 A1 * 9/2017 Sato ..... F16K 31/0675

FOREIGN PATENT DOCUMENTS

JP S63-086372 U 6/1988
JP H02-066380 A 3/1990
JP 2001-207939 A 8/2001
JP 2006-521484 A 9/2006
JP 2007-154855 A 6/2007
JP 2007-224896 A 9/2007
JP 2010-014214 A 1/2010
JP 2011-530671 A 12/2011

* cited by examiner

FUEL INJECTION VALVE

TECHNICAL FIELD

The present invention relates to fuel injection valves used for internal combustion engines, and more particularly to an electromagnetic fuel injection valve in which opening/closing operation of a valve element is carried out by passing current through a coil, whereby a magnetic flux is caused to a magnetic circuit including a movable element and a fixed iron core, thus causing magnetic attraction force to act so that the movable element is attracted toward the fixed iron core.

BACKGROUND ART

For emission reduction of an internal combustion engine, a fuel injection valve (injector) that feeds fuel to the engine is required to precisely meter an injection quantity, thereby suppressing uncontrollable fuel injection. To that end, the injector is required to reduce its quantity of fuel injected while a valve element bounces on a valve seat during valve closing.

A conventional fuel injection valve that is publicly known injects the fuel from its injection hole through use of magnetic attraction force generated by energization of a coil.

In such a fuel injection valve, when the coil is energized, the magnetic attraction force is generated between a fixed iron core and a movable iron core. With the magnetic attraction force generated between the movable iron core and the fixed iron core, the movable iron core is attracted toward the fixed iron core, and force is transmitted to a valve element integral with the movable fixed iron core, thereby moving the valve element in a direction away from a valve seat. The movable iron core and the valve element that are integral with each other have their movement restricted by collision with the fixed iron core, thus identifying their stop positions. In this case, the movable iron core integral with the valve element collides with the fixed iron core and bounces back from the fixed iron core on impact of the collision. When the energization of the coil is brought to a halt, the magnetic attraction force acting between the movable iron core and the fixed iron core disappears, and when the magnetic attraction force becomes smaller than elastic force of an elastic member urging the valve element, the valve element starts to move toward the valve seat, that is to say, in a valve closing direction. The valve element and the movable iron core have their movement restricted by collision of the valve element with the valve seat, thus identifying their resting positions. In this case, the valve element collides with the valve seat and on impact of this collision, moves in the direction away from the valve seat. In cases where a space results between the valve element and the valve seat, uncontrollable fuel is injected exteriorly from the injection hole.

To suppress such uncontrollable fuel injection, a structure such as disclosed in PTL 1 includes a movable iron core and a valve element that are provided separately.

CITATION LIST

Patent Literature

PTL 1: JP 2010-014214 A

SUMMARY OF INVENTION

Technical Problem

In the fuel injection valve, however, after the valve element collides with the valve seat, the valve element is rendered elastic under the influence of kinetic energy conserved in a valve closing process and thus undergoes elastic deformation. Thereafter, elastic energy conserved in a collision process translates into kinetic energy in the valve opening direction, that is, in the direction that separates the valve element away from the valve seat, thus causing bouncing. With the structure in which the movable iron core and the valve element are separated, reduction of initial energy of the valve element is possible but does not lead to suppression of a bouncing phenomenon that is caused as a result of the valve element being rendered elastic, so that the bouncing of the valve element that is caused as a result of the valve element being rendered elastic needs to be suppressed.

An object of the present invention is therefore to provide a fuel injection valve configured to suppress bouncing of a valve element that is caused as a result of the valve element being rendered elastic when the valve element collides with a valve seat.

Solution to Problem

To achieve the above object, a fuel injection valve according to the present invention includes a valve element configured to come into contact with a valve seat for closing an injection hole and to separate from the valve seat for unclosing the injection hole, an elastic member urging the valve element toward the valve seat, a movable iron core configured to be in and out of contact with the valve element, a fixed iron core opposed to the movable iron core, and a coil configured to generate electromagnetic force for moving the movable iron core, wherein at least one lower rigidity part having reduced rigidity per axial unit length is provided between a surface where urging force of the elastic member is transmitted to the valve element and a seat part whereat the valve element comes into contact with and separates from the valve seat, and wherein in a comparison between a value of axial rigidity of the valve element's side upstream of a center point axially of the valve element and a value of rigidity of the valve element's side downstream of the center point, the value of rigidity of the valve element's side having a center of gravity of the valve element is smaller.

Advantageous Effect of Invention

The present invention can suppress bouncing of the valve element that is caused as a result of the valve element being rendered elastic when the valve element collides with the valve seat.

DESCRIPTION OF EMBODIMENTS

The present invention is detailed hereinafter.

A valve element of the present invention includes a vibration absorbing part formed by including a lower rigidity part that has reduced rigidity per axial unit length as compared with another part of the valve element, and structurally, vibration is readily caused axially of the valve element for vibration absorption.

Thus, displacement and force that are caused to the vibration absorbing part leads to vibration in phase with vibration of a seat part of the valve element, so that force in anti-phase with inertial force caused by vibration of the valve element is generated. Accordingly, displacement of the seat part of the valve element can be suppressed, and consequently, bouncing can be suppressed.

Moreover, in a comparison between a value of rigidity of the valve element's side upstream of a center position axially of the valve element and a value of rigidity of the valve element's side downstream of the axial center position, the value of rigidity of the valve element's side having a center of gravity is smaller, whereby a difference between rigidity of the valve element's side upstream of the center of gravity of the valve element and a value of rigidity of the valve element's side downstream of the center of gravity is reduced. Accordingly, respective characteristic vectors of an upstream end point and a downstream end point of the valve element are of about the same value in a primary natural vibration mode axially of the valve element. The primary natural vibration mode axially of the valve element is such a vibration mode as to suppress the bouncing because vibrations at the respective upstream and downstream end points are in anti-phase relationship. For this reason, in a vibration mode with the valve element making contact with a valve seat, the vibration mode in which the vibrations occur in anti-phase relationship is easy to excite, whereby the bouncing of the valve element can be suppressed effectively. As such, a fuel injection valve capable of controlling a precise injection quantity can be provided.

It is to be noted that although the above description is provided, taking an electromagnetic fuel injection valve for example, the fuel injection valve is not limited to the electromagnetic type. Effects are similar even incases where the valve is driven by a piezoelectric element or a super magnetostrictive element.

Embodiments of the present invention are described hereinafter with reference to the accompanying drawings.

First Embodiment (Basic Structure of a Fuel Injection Valve)

Figure 1:
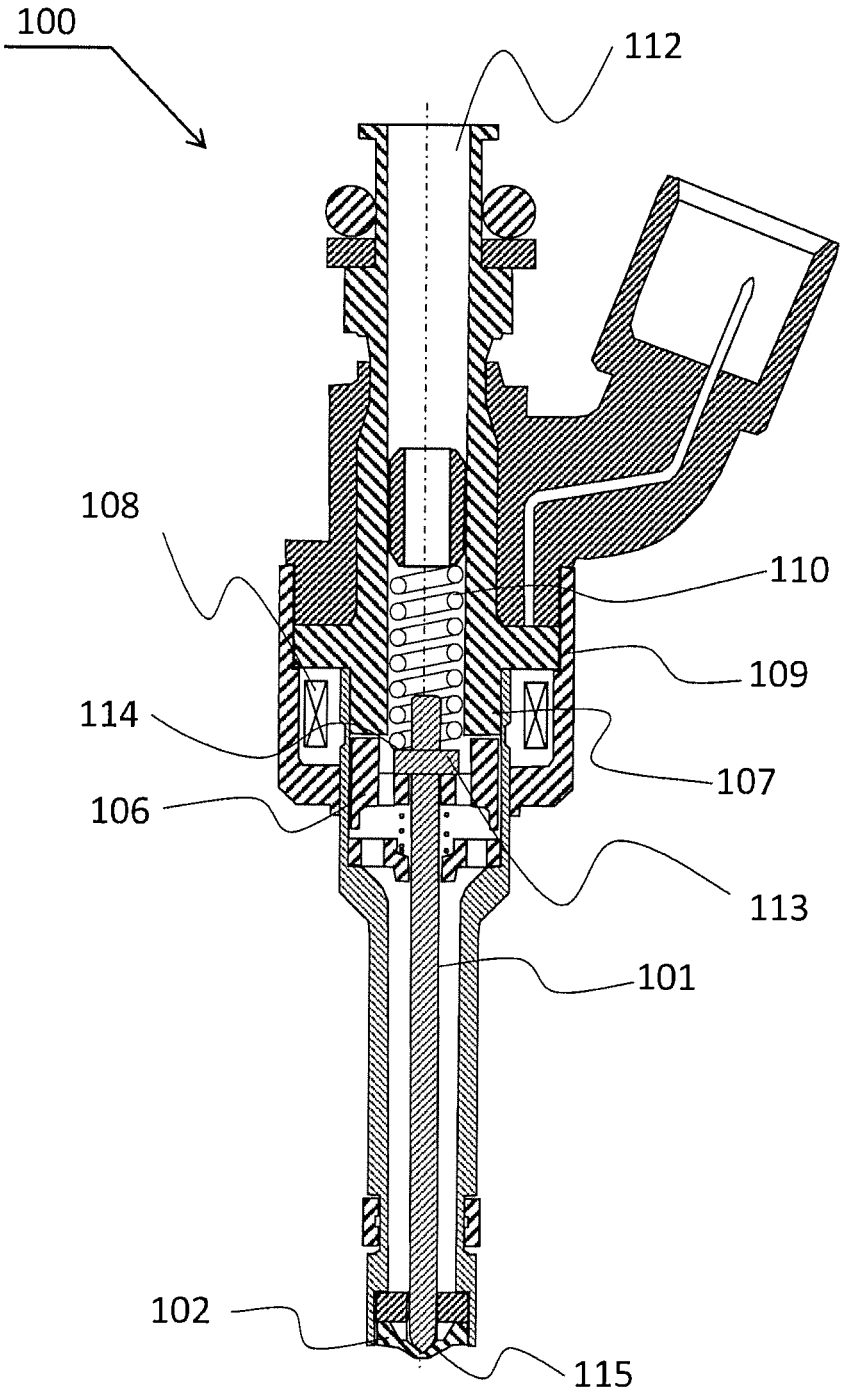
FIG. 1 is a sectional view illustrating an example of a fuel injection valve according to a first embodiment of the present invention.

FIG. 1 is a sectional view illustrating an electromagnetic fuel injection valve as an example of a fuel injection valve of the present invention. The electromagnetic fuel injection valve shown in FIG. 1 is an example used for a direct-injection gasoline engine but is also effective for a port-injection gasoline engine or as a fuel injection valve driven by a piezoelectric element or a magnetostrictive element.

(Basic Operation of the Fuel Injection Valve)

In FIG. 1, fuel is fed from a fuel feed port 112 into the fuel injection valve. The electromagnetic fuel injection valve 100 accommodates a valve element 101 and is provided with a valve seat 102 in a position opposed to the valve element 101. The valve seat 102 has a fuel injection hole that is not illustrated. The valve element 101 includes a flange 113 at its upstream end, and a spring 110 is provided to make contact with the flange 113. The valve element 101 is urged in a valve closing direction via a surface 114 that is provided on the flange 113 for transmitting urging force. The valve element 101 further includes a seat part 115 that forms a seal seat upon contact with the valve seat 102. When a coil 108 is not being energized, the valve element 101 is pressed by the spring 110 against the valve seat 102, thus sealing in the fuel.

It is to be noted that with respect to an axis of the fuel injection valve 100, a fuel-injection-hole side of the fuel injection valve 100 is explained as an upstream side, and a valve-seat side of the fuel injection valve 100 is explained as a downstream side.

When the coil 108 shown in FIG. 1 is energized, a magnetic flux is caused to a fixed iron core 107, a yoke 109, and a movable iron core 106 that form a magnetic circuit of the electromagnetic valve, thus producing magnetic attraction force in a gap between the fixed iron core 107 and the movable iron core 106. When the magnetic attraction force becomes greater than the urging force of the spring 110 and fuel pressure force, the valve element 101 is attracted toward the fixed iron core 107 via the movable iron core 106, thus establishing a valve opening state.

When the energization of the coil 108 is brought to a halt, the magnetic flux within the fixed iron core 107 disappears, and the magnetic attraction force acting on the movable iron core 106 reduces accordingly and disappears shortly. When the force of the urging spring 110 that acts on the valve element 101 becomes greater than the magnetic attraction force acting on the movable iron core 106, the valve element 101 shifts downstream and comes into contact with the seat member 102, whereby the valve is closed.

The above description has been provided of the basic operation of the electromagnetic fuel injection valve. For the purpose of controlling a fuel injection quantity, the fuel injection valve is designed to control a time period during which the valve element 101 is in opening condition through control of a time period during which the coil 108 is energized.

(Explanation of a Problem and a Bouncing Phenomenon)

Figure 2:
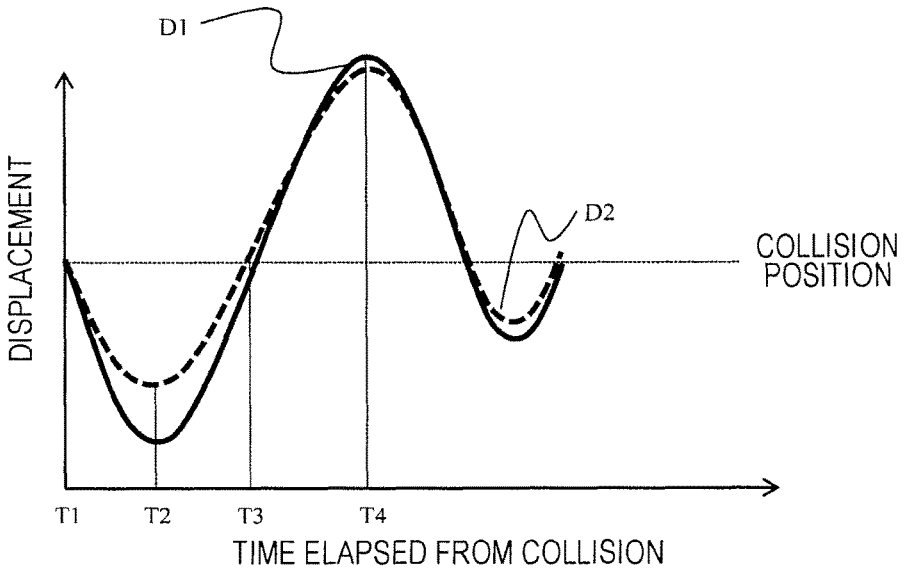
FIG. 2 illustrates behavior of a valve element when the valve element bounces in the fuel injection valve according to the first embodiment of the present invention.
Figure 3:
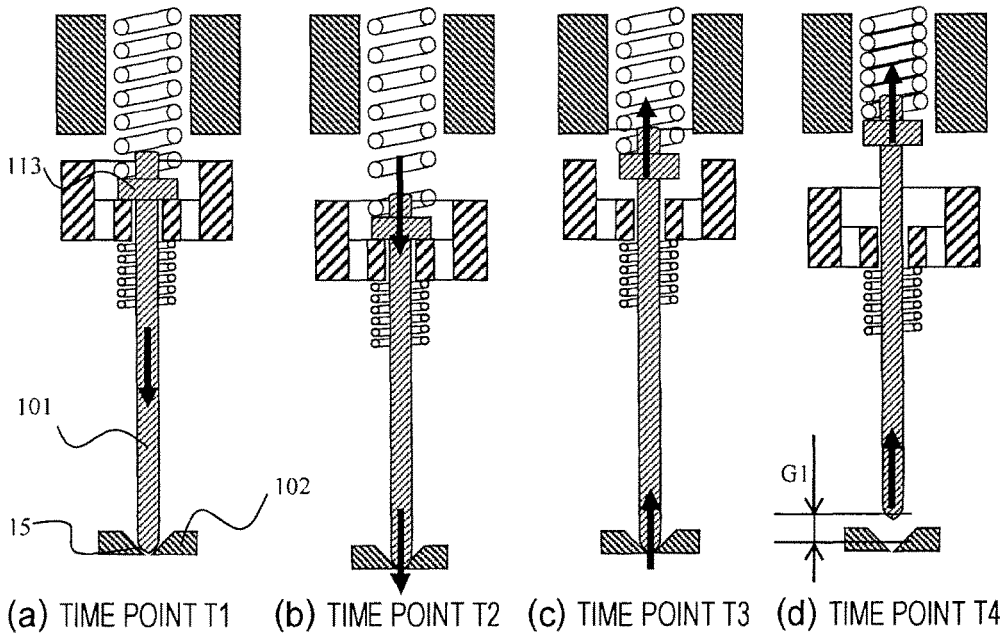
FIG. 3 illustrates motion of the valve element when the valve element bounces in the fuel injection valve according to the first embodiment of the present invention.

However, there are cases where the valve element 101 elastically deforms by colliding with the valve seat 102 during valve closing and consequently bounces in the fuel injection valve in which switching between energization and de-energization of the coil 108 is carried out for opening and closing operation of the valve element 101. With reference to FIGS. 2 and 3, a description is provided of the bouncing phenomenon of the valve element in a typical fuel injection valve not adopting the present invention. In FIG. 2, displacement of the flange 113 of the valve element 101 is represented by D1, while displacement of the seat part 115 of the valve element is represented by D2.

As shown in FIGS. 2 and 3, at a time point T1, the flange 113 and the seat part 115 of the valve element colliding with the valve seat 102 both move in a direction of the valve seat 102. Thereafter, the displacement of the flange 113 of the valve element becomes minimum at a time point T2, and kinetic energy conserved just before the collision is converted into elastic energy of the valve element 101.

After the displacement of the flange 113 of the valve element 101 reaches the minimum, the flange 113 starts to move in a direction away from the valve seat 102, that is to say, in a valve opening direction. The flange 113 reaches its maximum speed at a time point T3 where equilibrium is achieved by the urging force of the spring 110 and fuel pressure acting near the seat part 115, and restoring force of the valve element 101 rendered elastic and inertial force at the seat part 115 act to separate the seat part 115 away from the valve seat 102. At a time point T4, the bouncing finally takes place. An amount of bouncing corresponds to an axial distance G1 between the seat part 115 and the valve seat 102. Although separation of the movable iron core 113 enables reduction of initial energy of the valve element 101, the bouncing phenomenon caused as a result of the valve element 101 being rendered elastic cannot be suppressed, so that suppression of the bouncing that is caused as a result of the valve element 101 being rendered elastic is required.

As described above, the suppression of the bouncing that results from the elastic deformation of the valve element 101 in the collision of the valve element 101 with the valve seat 102 is the problem to be solved by the present invention. To achieve this object, that is to say, to enable bouncing suppression, a valve element 200 of the present invention includes a vibration absorbing part 208 formed by including a lower rigidity part 206 having reduced rigidity. The vibration absorbing part 208 thus formed easily vibrates axially of the valve element 101, that is to say, in valve opening and closing directions.

(Structure of Present Invention)

Figure 4:
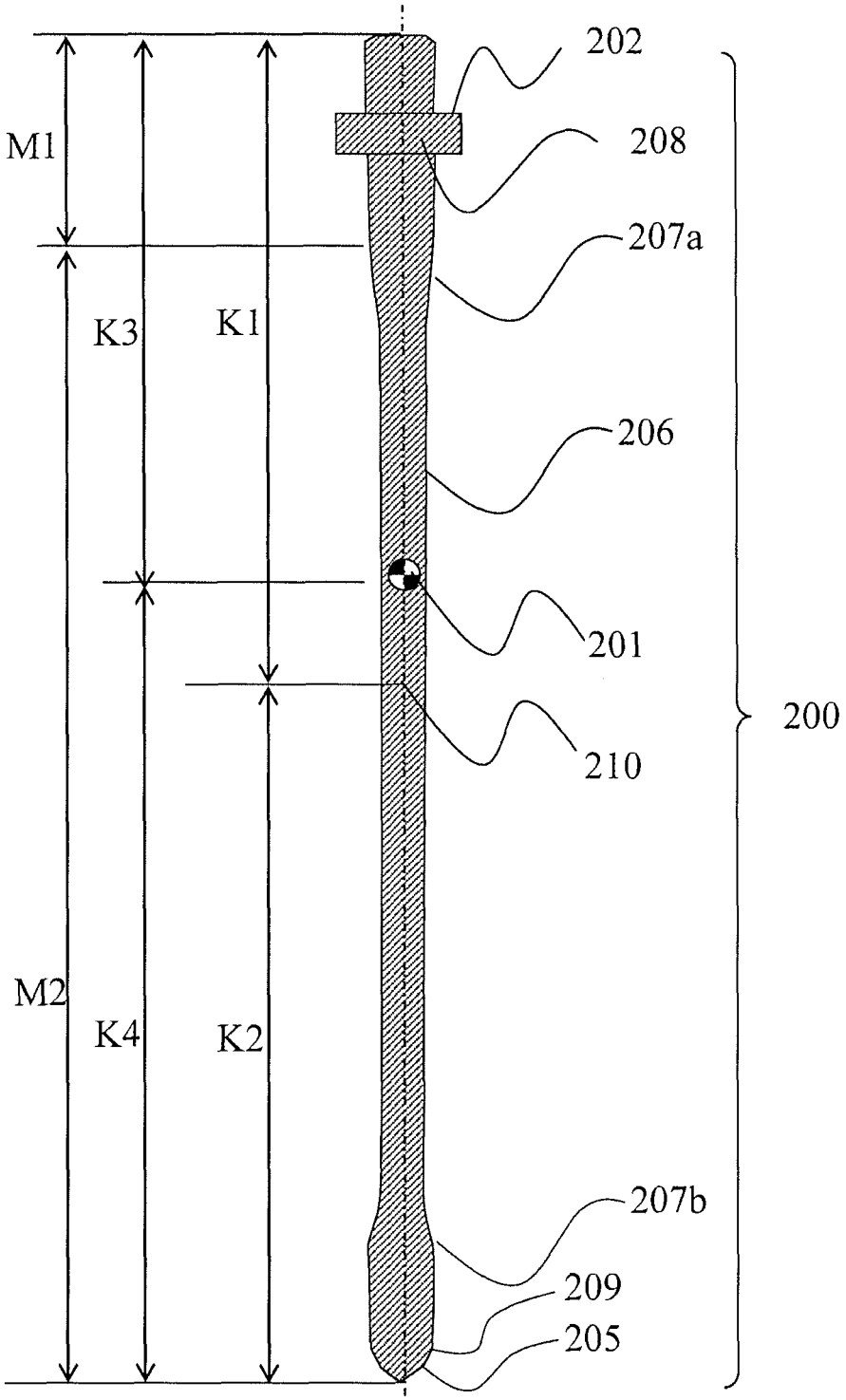
FIG. 4 is a sectional view of a valve element illustrated in an example of the fuel injection valve according to the first embodiment of the present invention.
Figure 5:
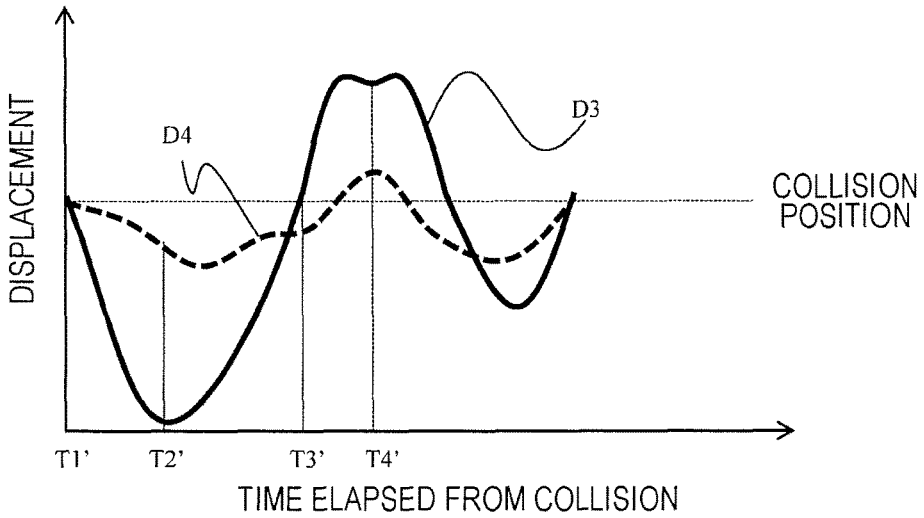
FIG. 5 illustrates behavior of the valve element when the valve element bounces in the fuel injection valve according to the first embodiment of the present invention.

In the present invention, the valve element 200 has such a shape as shown in FIG. 4 for the suppression of its bouncing. Structurally, the valve element 200 capable of suppressing its bouncing has, between a surface 202 where spring force is transmitted to the valve element to urge the valve element 200 and a seat part 205 that seals in the fuel upon contact between the valve element 200 and the valve seat 102, the lower rigidity part 206 that has the axially reduced rigidity per axial unit length as compared with the seat part. Moreover, when the valve element 200 is divided into a side upstream of its center point 210 and a side downstream of the center point 210, the side having a center of gravity 201 of the valve element 200 has a value of rigidity K1 that is smaller than a value of rigidity K2 of the counterpart. With such a structure, a difference can be made smaller between a value of rigidity K3 of the valve element's side upstream of the center of gravity 201 of the valve element 200 having the lower rigidity part 206 and a value of rigidity K4 of the valve element's side extending from the center of gravity to the seat part. It is alternatively preferable that the values of rigidity K3, K4 be about the same, and this is achieved by, for example, a lower-rigidity-part length setting and a lower-rigidity-part width setting. Furthermore, the valve element 200 preferably has such a mass relationship that a mass M1 of the vibration absorbing part 208 positioned upstream of the lower rigidity part 206 is smaller than a mass M2 of a downstream side including the lower rigidity part 206.

A structure for easy formation of a lower rigidity part that has reduced rigidity such as described above is as follows. The lower rigidity part 206 has a reduced diameter as compared with a maximal point 209, being a first maximal value appearing upstream of the seat part 205, and connects with connecting portions 207*a*, 207*b* on the respective upstream and downstream sides. The connecting portions 207*a*, 207*b* are each formed into a curved surface having at least one inflection point and are connected smoothly.

(Functional Effects)

With the lower rigidity part 206 achieved by outer-diameter reduction being provided between the surface 202 where the urging force is transmitted and the seat part 205, an increased amount of deformation can be obtained for the vibration absorbing part 208 in a collision of the valve element 200 with the valve seat 102. The increased amount of deformation of the vibration absorbing part 208 facilitates conversion of kinetic energy conserved for the valve element in a valve closing process into an amount of deformation of the vibration absorbing part 208, so that a decreased amount of deformation can be obtained in a position of the collision between the seat part 205 and the valve seat 102. With this decreased amount of deformation, inertial force caused at the seat part 205 of the valve element 200 in a direction away from the valve seat 102 reduces, whereby the bouncing can be suppressed for the valve element. In cases where the lower rigidity part 206 has a length setting and a width setting so that the value of rigidity K3 of the valve element's side extending from the center of gravity 201 of the valve element 200 to the surface 202 where the urging force is transmitted is about the same as the value of rigidity K4 of the valve element's side extending from the center of gravity 201 to the seat part 205, or the difference between these values of rigidity is within 20%, a rate of contribution of a natural vibration mode that is excited in the collision changes, meaning that a vibration mode such as to suppress bouncing can be excited with ease.

With the typical fuel injection valve, a vibration mode that has a highest rate of contribution to the bouncing of the valve element is a vibration mode in which the surface 114 where the urging force is transmitted and the seat part 115 of the valve element vibrate in phase. However, with the valve element that is provided with the above lower rigidity part 206 having its length and its width fixed so that the value of rigidity K3 of the valve element's side extending from the center of gravity 201 of the valve element to the surface 202 where the urging force is transmitted is about the same as the value of rigidity K4 of the valve element's side extending from the center of gravity to the seat part, characteristic vectors in the primary natural vibration mode axially of the valve element alone thus have respective absolute values that are about the same and are in sign-inverted or anti-phase relationship in the vibration mode.

Figure 6:
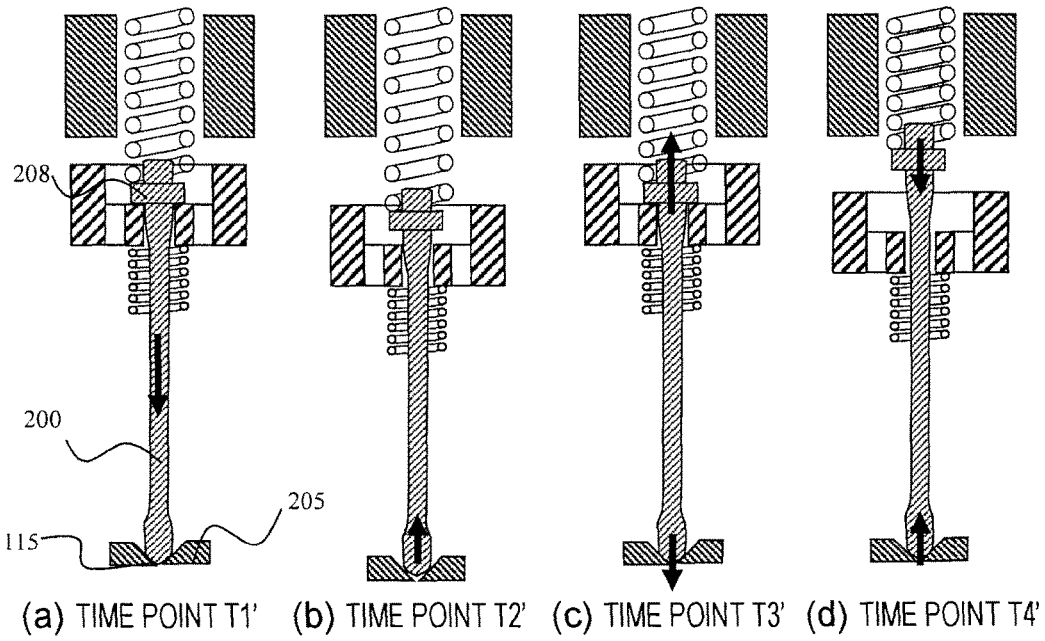
FIG. 6 illustrates motion of the valve element when the valve element bounces in the fuel injection valve according to the first embodiment of the present invention.
Figure 7:
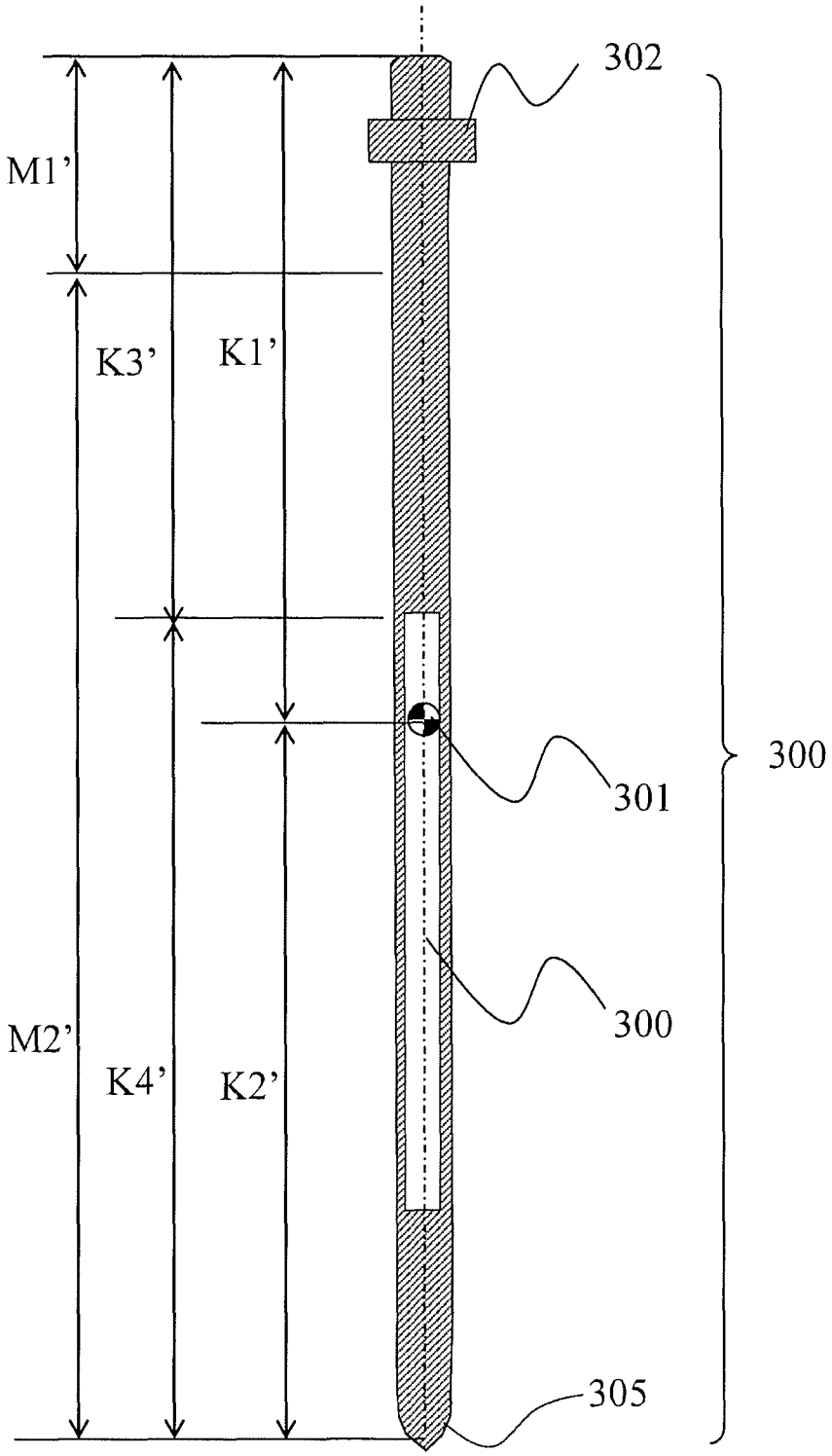
FIG. 7 is a sectional view of a valve element illustrated in an example of a fuel injection valve according to a second embodiment of the present invention.

With reference to FIGS. 6 and 7, a description is provided of a bounce suppressing mechanism of the anti-phase vibration mode of the valve element 200. FIG. 6 illustrates displacement D1 of the vibration absorbing part 208 of the valve element 200 and displacement D2 of the seat part 205 of the valve element 200 in a collision. FIG. 7 illustrates motion of the movable part of the fuel injection valve at each time point in the collision with arrows each indicating a direction of the motion. At a time point T1', the vibration absorbing part 208 and the seat part 205 of the valve element colliding with the valve seat both move in a direction of the valve seat 102. Thereafter, the displacement of the vibration absorbing part 208 of the valve element becomes minimum at a time point T2', and kinetic energy conserved just before the collision is converted into elastic energy of the valve element 200. After the displacement of the vibration absorbing part 208 of the valve element reaches the minimum, the vibration absorbing part 208 of the valve element starts to move in a direction away from the valve seat 102, that is to say, in a valve opening direction. The vibration absorbing part 208 reaches its maximum speed at a time point T3' where equilibrium is achieved by the urging spring force and fuel pressure . At a time point T3', separation of the seat part 205 from valve seat 102 as a result of the valve element 200 being rendered elastic can be suppressed by vibrational energy of the vibration absorbing part 208 because the mass M2 of the downstream side including the lower rigidity part 206 is larger than the mass M1 of the side upstream of the lower rigidity part 206. Moreover, the respective characteristic vectors of the vibration absorbing part 208 and the seat part 205 in the primary natural vibration mode axially of the valve element alone have the respective absolute values that are about the same and are in anti-phase relationship, so that at the time point T3' where the vibration absorbing part 208 reaches its maximum speed, the seat part 205 of the valve element moves in the valve closing direction that is opposite to the direction of the vibration absorbing part 208. Consequently, bouncing of the valve element 200 can be suppressed at a time point T4'. Here, the bouncing of the valve element can be suppressed completely when the inertial force of the seat part 205 and restoring force of the valve element 200 become smaller than fuel pressure force. Even in cases where the inertial force and the restoring force of the valve element 200 become larger than the fuel pressure force, the bouncing of the valve element 200 can be suppressed because the seat part 205 moves in the direction that suppresses the bouncing of the valve element 200.

As described above, the anti-phase vibration mode is easy to excite when the valve element 200 having the lower rigidity part 206 collides with the valve seat 102. This anti-phase vibration mode drivingly causes the seat part 115 to move in the valve closing direction opposite to the valve opening direction when an upper part of the valve element 200, that is, the vibration absorbing part 208 tries to move in the valve opening direction. As a result, the valve element 200 is effected in the direction that suppresses its bouncing, and the bouncing can be suppressed even under lower fuel pressure conditions. Moreover, the connecting portions 207*a*, 207*b* connecting with the lower rigidity part 206 on the respective upstream and downstream sides are connected smoothly, so that concentration of stress can be suppressed in the collision.

With the above structure, the bouncing is suppressed, whereby uncontrollable fuel injection can be suppressed. Even in cases where, for example, the force of the spring 110 that urges the valve element 200 is increased for improved speed just before the collision of the valve element 200 with the valve seat 102, bouncing can be suppressed. Thus, in addition to improvement in responsiveness, with the improved speed at which valve closing is carried out by the urging force, a smaller lift amount can be achieved for the valve element 200, and coarse particles can be reduced in a region where a fuel flow rate might otherwise drop due to increased pressure loss.

Consequently, the fuel injection valve can be provided as being capable of reducing harmful gas emitted from an automobile. According to the above structure, the vibration absorbing part 208 performs vibration absorption, so that reduction of load that is transmitted by the valve element 200 to the valve seat 102 can be achieved. Consequently, not only can wear suppression be achieved in a collision between the valve element 200 and the valve seat 108, the fuel injection valve contributes to noise reduction, whereby an engine system having its noise reduced can be provided.

In the present embodiment described, the rigidity is reduced at one part as shown in FIG. 4. However, it is to be noted that similar effects can be obtained even in cases where the rigidity is reduced at a plurality of parts.

Second Embodiment

FIG. 7 is a sectional view of a valve element 300 according to a second embodiment of the present invention. It is to be noted that the valve element 300 differs in shape from the valve element of the first embodiment. Descriptions of those components in the drawing that have the same reference marks as the components of the first embodiment are omitted.

Structurally, the valve element 300 of the second embodiment that is capable of suppressing its bouncing has, between a surface 302 where urging force of a spring 110 is transmitted to urge the valve element 300 and a seat part 205 that seals in fuel upon contact between the valve element 300 and the valve seat 102, a lightened part 306 that has axially reduced rigidity per axial unit length as compared with the seat part. Moreover, when the valve element 300 is divided into a side upstream of its center point 310 and a side downstream of the center point 310, the side having a center of gravity 301 of the valve element 300 has a value of rigidity K1' that is smaller than a value of rigidity K2' of the counterpart. With such a structure, a difference can be made smaller between a value of rigidity K3' of the valve element's side upstream of the center of gravity 301 of the valve element 300 having the lightened part 306 and a value of rigidity of the valve element's side extending from the center of gravity to the seat part K4'. It is alternatively preferable that the values of rigidity K3', K4' be about the same, and this is achieved by, for example, a lower-rigidity-part length setting and a lower-rigidity-part width setting that are not, however, restrictive. Furthermore, the valve element 300 preferably has such a mass relationship that a mass M2 is larger than a mass M1 of a vibration absorbing part 308 positioned upstream of the lightened part 306. Consequently, the vibration absorbing part 308 absorbs energy in a collision, whereby the valve element 300 can suppress its bouncing.

Third Embodiment

Figure 8:
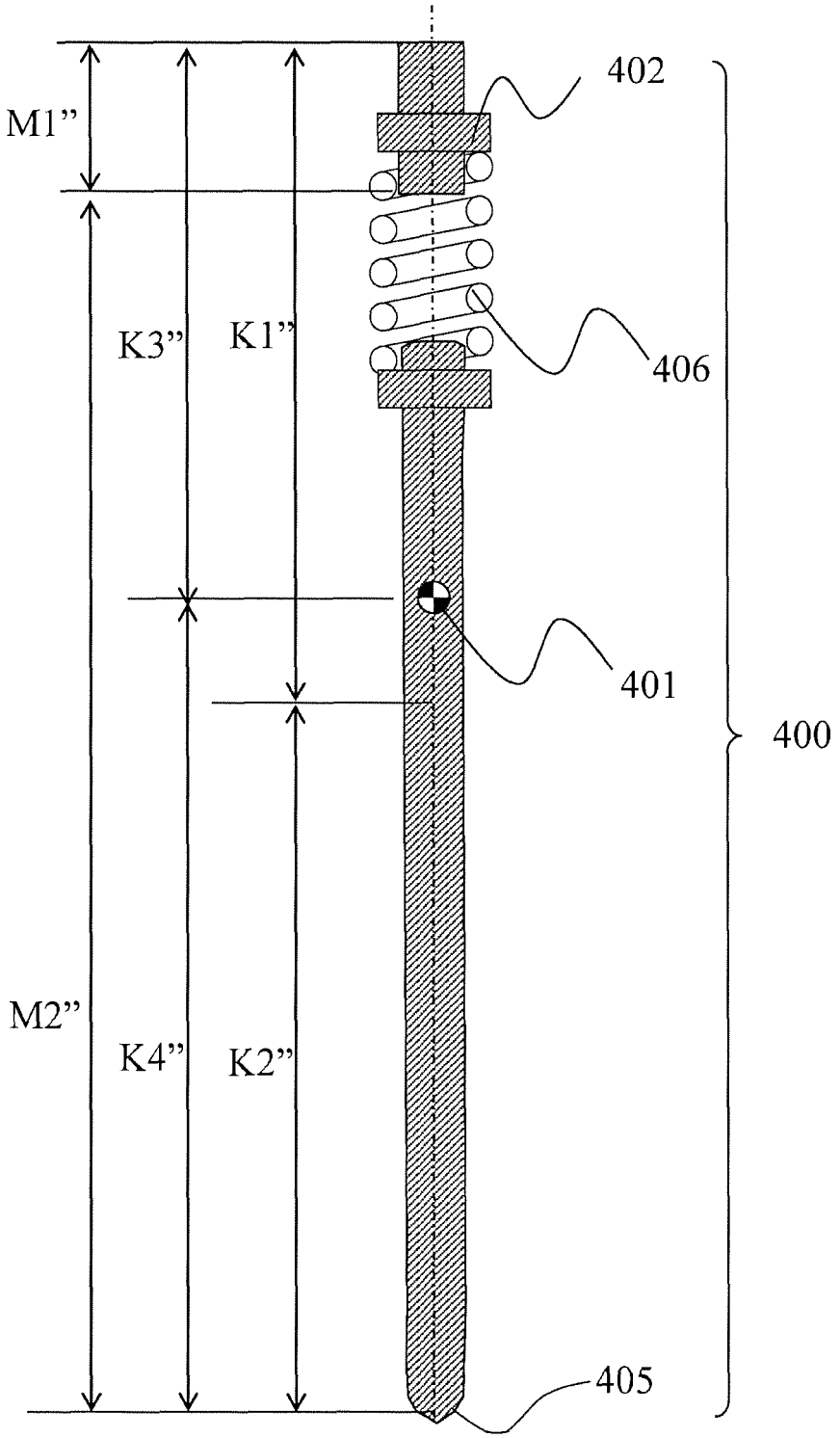
FIG. 8 is a sectional view of a valve element illustrated in an example of a fuel injection valve according to a third embodiment of the present invention.

FIG. 8 is a sectional view of a valve element 400 according to a third embodiment of the present invention. This valve element 400 differs in shape from the valve elements of the first and second embodiments. Descriptions of those components in the drawing that have the same reference marks as the components of the first embodiment are omitted.

Structurally, the valve element 400 of the third embodiment that is capable of suppressing its bouncing has an elastic member 406 interposed between a surface 402 where urging force is transmitted to the valve element to urge the valve element 400 and a seat part 405 that seals in fuel upon contact between the valve element 400 and the valve seat 102. Moreover, when the valve element 400 is divided into a side upstream of its center point 310 and a side downstream of the center point 310, the side having a center of gravity 401 of the valve element 400 has a value of rigidity K1" that is smaller than a value of rigidity K2" of the counterpart. With such a structure, a difference can be made smaller between a value of rigidity K3" of the valve element's side upstream of the center of gravity 401 of the valve element 400 having the elastic member 406 and a value of rigidity of the valve element's side extending from the center of gravity to the seat part K4". It is alternatively preferable that the values of rigidity K3", K4" be about the same, and this is achieved by a rigidity setting of the elastic member 406 that is not, however, restrictive. Furthermore, the valve element 400 preferably has such a mass relationship that a mass M2 is larger than a mass M1 of a vibration absorbing part 408 positioned upstream of the elastic member 406. With the above structure, the vibration absorbing part 408 absorbs energy in a collision, whereby the valve element 400 can suppress its bouncing.

REFERENCE SIGNS LIST

101, 200, 300, 400 valve element
102 valve seat
106 movable iron core
107 fixed iron core
108 coil
109 yoke
110 spring
112 fuel feed port
113 flange
114, 202, 302, 402 surface where urging force is transmitted
115, 205, 305, 405 seat part
201, 301, 401 center of gravity
206, 207*a* lower rigidity part
207*a*, 207*b* connecting portion
208, 308, 408 vibration absorbing part
210, 310, 410 center point

The invention claimed is:

1. A fuel injection valve comprising a valve element configured to come into contact with a valve seat for closing an injection hole and to separate from the valve seat for unclosing the injection hole, an elastic member configured to urge the valve element toward the valve seat, a movable iron core configured to selectively be in or out of contact with the valve element, a fixed iron core opposed to the movable iron core, and a coil configured to generate electromagnetic force for moving the movable iron core, wherein at least one lower rigidity portion of the valve element that has a reduced axial rigidity compared to an axial rigidity of a seat portion of the valve element at which the valve element selectively comes into contact with or separates from the valve seat is provided between a surface of the valve element configured to receive an urging force of the elastic member and the seat portion, and wherein in a comparison between a value of axial rigidity of a side of the valve element upstream of an axial center point of the valve element and a value of axial rigidity of a side of the valve element downstream of the center point, the value of rigidity of whichever of the upstream side and the downstream side that includes a center of gravity of the valve element is smaller.

2. The fuel injection valve according to claim 1, wherein a side of the valve element that is positioned upstream of the lower rigidity portion has a smaller mass than a downstream side of the valve element that includes the lower rigidity portion.

3. The fuel injection valve according to claim 2, wherein a value of axial rigidity of a side of the valve element upstream of the center of gravity of the valve element is about the same as a value of rigidity of a side of the valve element downstream of the center of gravity.

4. The fuel injection valve according to claim 3, wherein a difference between the value of axial rigidity of the side of the valve element upstream of the center of gravity of the valve element and the value of rigidity of the side of the valve element downstream of the center of gravity is within 20%.

5. The fuel injection valve according to claim 1, wherein the lower rigidity portion of the valve element has a smaller outer diameter than a diameter of the valve element adjacent to the seat portion.

* * * * *